United States Patent [19]

Bedini

[11] Patent Number: 4,555,795

[45] Date of Patent: Nov. 26, 1985

[54] MONAURAL TO BINAURAL AUDIO PROCESSOR

[75] Inventor: John C. Bedini, Sylmar, Calif.

[73] Assignee: TVI Systems, Ltd., Los Angeles, Calif.

[21] Appl. No.: 515,581

[22] Filed: Jul. 21, 1983

Related U.S. Application Data

[63] Continuation-in-part of Ser. No. 400,631, Jul. 22, 1982.

[51] Int. Cl.[4] ..... H04R 5/00

[52] U.S. Cl. ..... 381/17; 330/59; 381/94

[58] Field of Search ..... 381/17, 18, 94; 330/59

[56] References Cited

U.S. PATENT DOCUMENTS

| | | | |
|---|---|---|---|
| 3,156,769 | 11/1969 | Markowitz | 381/17 |
| 3,560,656 | 2/1971 | Gilbert | 381/17 |
| 3,670,106 | 6/1972 | Orban | 381/17 |
| 3,911,776 | 10/1975 | Beigel | 330/59 X |
| 3,980,964 | 9/1976 | Grodinsky | 330/59 X |
| 4,239,939 | 12/1980 | Griffis | 381/17 |
| 4,308,424 | 12/1981 | Bice, Jr. | 381/17 |

OTHER PUBLICATIONS

Sansui Corp., Advertisement in *Stereo Review*, Aug., 1979.

*Primary Examiner*—R. J. Hickey

*Attorney, Agent, or Firm*—Stanley A. Becker; James W. McClain

[57] ABSTRACT

An audio processor which converts monaural input to a realistic pleasant sounding binaural output in which optical coupling means, having a nonlinear transfer characteristic, creates an unbalanced output to a pair of audio outputs. The system provides for a high or low level input, which may be selected by a switch, to an emitter follower which drives an optical coupling circuit. The optical coupling circuit is comprised of a light emitting diode and a phototransistor connected in a phase splitting network. The phase splitting network provides an unbalanced output to terminals for connecting to preamplifiers, amplifiers, etc. An alternative embodiment employs two optical coupling circuits in two separate signal processing channels, including two phase splitting networks.

39 Claims, 12 Drawing Figures

MONAURAL TO BINAURAL AUDIO PROCESSOR

CROSS REFERENCE TO RELATED APPLICATIONS

This application is a continuation-in-part of application Ser. No. 400,631 filed July 22, 1982.

TECHNICAL FIELD

This invention relates generally to audio circuits and more particularly relates to audio circuits for processing monaural input signals.

BACKGROUND ART

Nature has endowed human beings with two ears so that our hearing is binaural. Early musical reproductions were monaural, which was analogous to going through life with one ear covered. Thus, sensations of spaciousness (width and depth) and imaging (location) were lost. These sensations are perceived by the brain as a result of subtle differences in sound amplitude and phase reaching our ears. Such sensations help us orient ourselves by sound even without the aid of our eyes and gives sound a natural character even when reproduced artificially.

To explain further how binaural hearing gives sound a "natural character", consider a large concert hall with a full orchestra on a stage at one end thereof, and a listener seated facing the orchestra towards the other end thereof. As the instruments on the listener's left side produce sound waves, these sound waves reach the listener's left ear slightly sooner in time than they reach the listeners right ear. This slight difference in time (which may be on the order of only a millisecond), between the sound as heard with the left ear and the same sound as heard by the right ear, enables the listener to discern even without looking (i.e., even if blindfolded), that the sound is coming from the left side of the stage. Thus, if the sound wave is heard by one ear slightly before the same sound wave is heard by the other ear, this difference in time (commonly referred to as a "phase change"), helps the listener identify the "location" or "image" of the sound source. Similarly, if the sound wave is heard by both ears at the same time, then the listener can ascertain that the source of the sound is more or less at the center of the stage. Likewise, if a different second sound wave (e.g., from a different source) is heard by both ears at approximately the same time but slightly delayed from an earlier first sound wave, then the listener knows that the source of the second sound wave is positioned behind the source of the first sound wave on the stage. If a corresponding phase change accompanies the reception of these first and second signals, the listener is further able to determine whether these first and second sources are positioned to the left or right on the stage. Hence, when all of the sound waves emanating from all of the orchestral instruments placed all around the stage are combined, the listener knows (even without the aid of sight) that the orchestra has "width" and "depth" (spaciousness) associated therewith; and is further able to "locate" or "image" where selected instruments (sources of sound) are placed on the stage, especially if the listener can readily "pick out" or discern the sound of one instrument from the others.

In contrast, if the source of the sound waves is emanating from a single point source, such as a speaker of a monaural sound system, the sound heard, regardless of the fidelity or signal integrity thereof, is not natural because it has no discernable depth or width associated therewith. Further, imaging is not possible, because the sound waves all emanate from the same location. While stereo and other multi-channel systems (the "stereo effect") improve the quality of the sound a great deal, the sound is still not truly natural in the sense that the imagining and depth/width that are achieved are highly dependent upon the placement of the speakers and the position of the listener relative thereto.

Prior art systems which simulate or synthesize stereo from a monaural audio source have generally been realized by employing two channel reproductions with the second channel delayed from the first. In addition, positive feedback was added which causes an effect similar to reverberation and thus enhances the results. However, most of these devices have failed to achieve any commercial success because a substantial portion of the frequency response has been lost in the attempt to synthesize the stereo effect. This occurs partially because of the very fact that the signals are substantially out of phase. A similar effect can be heard by connecting out of phase speakers to a stereo source. A substantial loss of spaciousness and imaging as well as fidelity can be perceived.

Another prior art device attempts to simulate stereo by splitting frequencies or shunting audio signals in and out of phase, mostly in a lead and lag situation. One such device is disclosed in U.S. Pat. No. 3,670,106 of Orban. This device takes an input source and splits it into five bands, then changes the phases of each band according to frequency to produce a stereo effect. However, by splitting frequencies a certain amount of music information is lost where these frequencies cross over because of an out-of-phase condition. Further, when summing amps are used to put the signal together again, there will be another loss in separation.

Another device, disclosed in U.S. Pat. No. 3,156,769 of Markowitz, uses incandescent lights which drive a photoresistor to shunt the input signals to a power amplifier. In this circuit, the incandescent bulbs or lights are somewhat slow in reacting and are only good for a certain period of time. As the light gets increasing carbon buildup on the glass envelope, its intensity will change, resulting in a change in impedance out of the photoresistor for shunting ability. Thus, while this circuit will in effect simulate two separate channels, there is a great loss of quality (i.e., clarity and fidelity) of the sound reproduction because of the difference in phase as well as the loss of some frequencies.

DISCLOSURE OF INVENTION

A principal purpose of the present invention is to provide a high quality set of binaural audio processed output signals from a monaural input signal.

In one embodiment of the invention, the audio processed binaural output is achieved by utilizing an optical coupling device having a nonlinear transfer characteristic, driven by an emitter follower to produce a signal that drives a phase splitting network. A monaural signal is applied to a low impedance driver in the form of a transistor whose emitter drives a light emitting diode coupled to a phototransistor. Simultaneously, a small bias current from the emitter of the transistor is applied to the base of the phototransistor. The small bias current is applied by a frequency sensitive network. This bias current provides a change in the sensitivity, and hence transfer characteristics, of the phototransistor. The phototransistor is connected in a phase splitting network having an unbalanced output in the form of a binaural audio processed signal.

The two channels of the binaural output are generated by connecting the phototransistor as a phase splitter having emitter and collector load resistors such that there is a deliberate unbalance between the two outputs. The unbalanced outputs coupled with the frequency sensitive variations in the phototransistor's transfer characteristics provide a desirable phase difference between the two binaural output signals. Advantageously, this phase difference responds rapidly to the audio frequency inputs such that no loss of fidelity or clarity in the reproduction of the audio input occurs. No frequencies are lost because the listener hears signals modified dynamically by the interaction of the collector load resistor unbalance and nonlinear transfer characteristics of the optical coupling means and the phase splitter, which interactions provide a substantially true binaural reproduction of the monaural input.

To further enhance the signal produced by this embodiment of the invention, a potentiometer is added to the phase splitter to provide an effective calibrate control. With the potentiometer, the unbalanced phase splitter can be varied over a wide range to optimize the binaural output.

An additional control is provided to adjust the depth or presence of the binaural signal in a manner similar to a balance control on stereo amplifying device systems. An imaging control provides a dynamic feedback summing circuit to vary the bias on the base of the phototransistor, thus effectively varying the imaging of the binaural audio processed output signals. The binaural audio processed output signals are coupled through preamplifiers or amplifiers and then to suitable speaker systems. If desired, bass boost may also be included. This is a particular advantage over the prior art synthesized stereo signals which were unable to provide any bass boost because of the already apparent loss of frequencies and the seeming "tinniness" of the sound reproduction.

The audio processor of the present invention also provides a significant improvement over stereo used with video. That is, the audio processor appears to couple the video with sound from the video screen, while stereo may not. Through use of the present invention, when there is information on the screen, the sound appears to emanate from the screen, and not just from the speakers, as is often the case with stereo. With stereo the sound seems to emanate from either side of the video or to float between the video and the listener. This is due in large part to the rigid phase relationships that are maintained between the stereo signals, coupled with the particular placement of the stereo speakers relative to the listener. Thus, in a pure stereo/video system, the sound may not couple well with the video, resulting in a mismatch between the picture and sound, such as a picture that appears too small, too flat or out of synchronization with the sound.

A dot bar LED display is also optionally included to give a visual indication of the variation of the binaural audio outputs and the power output. The dot bar generators are conventional LED circuits having a bar dot driver and operational amp calibrated by a potentiometer.

In an alternative embodiment of the audio processor portion of the invention, the monaural input signal is advantageously processed through two separate channels, thereby adding more of a stereo effect to the binaural output signals. In this embodiment, the monaural input signal is split into two separate signals by a frequency sensitive signal splitting network. Each split signal is directed to the base of a separate phototransistor, and each phototransistor is further optically coupled to a respective light emitting diode, which diode is driven by separate monaural input signals derived from respective driver circuits. Resistive loads placed in the collector and emitter legs of each phototransistor create separate phase splitter networks, with approximately out-of-phase signals being provided across the collector and emitter loads respectively.

Two output signals are thus provided from each phototransistor/phase-splitting network, making a total of four signals. These four signals are then appropriately combined in a frequency sensitive signal combination network to provide the desired two binaural output signals.

As with the first embodiment of the audio processor circuit previously described, this second embodiment relies on the nonlinear transfer characteristics of the phototransistors to generate desired unbalanced phase and amplitude changes in the binaural output signals. However, unlike the first embodiment, this second embodiment utilizes two signal processing channels, each having its own phase splitter network driven by a respective phototransistor. Each phototransistor is primarily controlled by one of the two split signals derived from the frequency sensitive signal splitting network. Thus, the signals driving each phototransistor (the signals applied to the base terminals thereof) are not the same, each being dominated with signals in a different frequency range. The operating characteristics of both phototransistors are further modified by optical energy coupled to the phototransistors through the light emitting diodes. In theory, this optical energy is the same because it is derived from the same source (the monaural input signal); but in practice, it will always be somewhat unbalanced due to the separate driver circuits used to deliver the signals to the light emitting diodes. Thus, because the operating points of each phototransistor are not the same due to the different signals applied to their respective base terminals, and further because each phototransistor exhibits a different nonlinear transfer characteristic as a function of its operating point, and still further because the optical energy coupled to the phototransistors will always be somewhat unbalanced, a highly desirable mixture of signals, produced through two separate channels (thereby adding the stereo effect), each having a variation in phase and amplitude with regard to the monaural input signal, and the combination of which contains all the frequencies of the monaural input signal, is generated. This mixture of signals is then appropriately combined in the frequency sensitive signal combination network to produce the two desired binaural output signals.

Advantageously, the monaural to binaural processing system of the present invention may be used for a wide variety of applications, as discussed in more detail hereinafter. It may be used to generate a binaural output from a single monaural input or from a plurality of monaural inputs. In the latter case, for example, the system may process stereo signals by connecting a first processing system according to the present invention to the left channel of a conventional stereo system, and by connecting a second processing system to the right channel. The resulting four output signals (two from each processing system) may then be appropriately combined as desired to produce the binaural output signals. Alternatively, the stereo signals may be processed through one processing system.

Thus, it is one object of the present invention to provide an audio processing circuit which will produce a binaural output from a monaural input.

Another object of the present invention is to provide an audio processing system which will provide a binaural output from a monaural input without loss of any frequency response.

Still another object of the present invention is to provide an audio processing system which produces a binaural output from a monaural input by utilizing a controlled nonlinear transfer function.

Yet another object of the present invention is to provide an audio processing circuit which will produce a binaural output from a monaural input by utilizing an unbalanced phase splitting network.

Still another object of the present invention is to provide an audio processing system which will produce a binaural output from a monaural input utilizing an optical coupler.

Yet another object of the present invention is to provide an audio processing circuit which will produce a binaural output from a monaural input by utilizing light emitting diode means and phototransistor means.

Yet another object of the present invention is to provide an audio processing circuit to produce a binaural output from a monaural input which provides an unbalanced phase splitter at the output.

Yet another object of the present invention in one embodiment thereof, is to provide an audio processing system to produce a binaural output from a monaural input having effective calibrate means in a phase splitting network.

Yet another object of the present invention is to provide an audio processing circuit which will produce a binaural output from a monaural input which will have a dynamic feedback network to provide imaging control.

A still further object of the present invention, in another embodiment thereof, is to provide a monaural to binaural audio processing system wherein the signal is processed through two separate channels, thereby introducing more of the stereo effect in the binaural output signals.

Another object of the invention is to provide such a dual-channel monaural to binaural audio processing system utilizing independent optical coupling means in each channel for desirably introducing similar but nonequal phase and gain variations in the signals being processed.

A further object of the invention is to provide such a dual-channel monaural to binaural audio processing system wherein the monaural signal is split into two signals, each being processed in one of the channels, according to the frequency content of the monaural input signal.

Still another object of the present invention is to provide a dual-channel monaural to binaural signal processing system that may be used to process a single monaural input or a plurality of input signals, if a corresponding plurality of such processing systems are employed.

Yet a further object of the present invention is to provide a signal processing system that effectively filters out undesirable noise in the input signals.

An additional object of the invention is to provide an audio signal processing system wherein a set of binaural audio output signals derived from a monaural audio input signal produces sensations of depth, width, and imaging when the output signals are converted to sound.

A further object of the invention is to provide such an audio signal processing system wherein the set of binaural audio output signals may be recorded in any desired audio signal recording medium, such as a magnetic tape or a phonograph disc, and the sensations of depth, width, and imaging are preserved upon playback of these recorded signals.

BRIEF DESCRIPTION OF DRAWINGS

The above and other objects, advantages and novel features of the invention will be more fully understood from the following more detailed description of the invention, presented in conjunction with the accompanying drawings in which.

MODES FOR CARRYING OUT THE INVENTION

Figure 1:
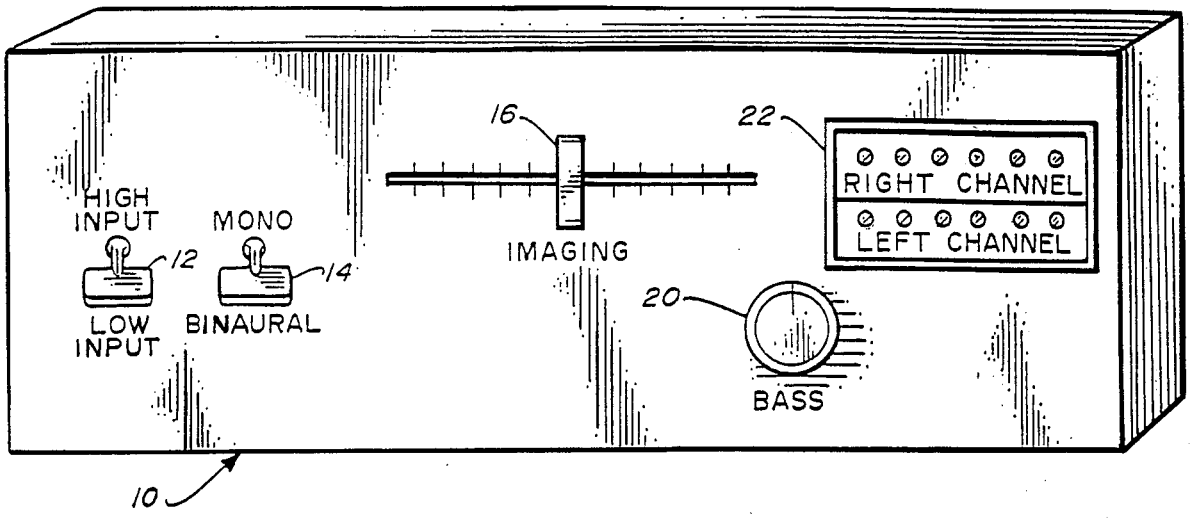
FIG. 1 is a perspective view of an audio processing system according to one embodiment of the invention.

One embodiment of the monaural to binaural audio processing system according to the invention is illustrated generally in FIG. 1. The audio processor 10 has a variety of controls and displays. Switch 12 provides for selection of high or low inputs depending upon the source the audio processor is connected to. The low input position selects a source such as a directly connected speaker outputs, while the high input position selects such high level outputs as a VCR output. Switch 14 provides for selection of the monaural output or the audio processed binaural output. Slide control 16 is for imaging control as will be described in greater detail hereinafter. A dual concentric control 20 is provided for bass boost control. Lastly, a dot bar LED display 22 provides an indication of amplitude and output of right and left channels respectively.

Figure 2:
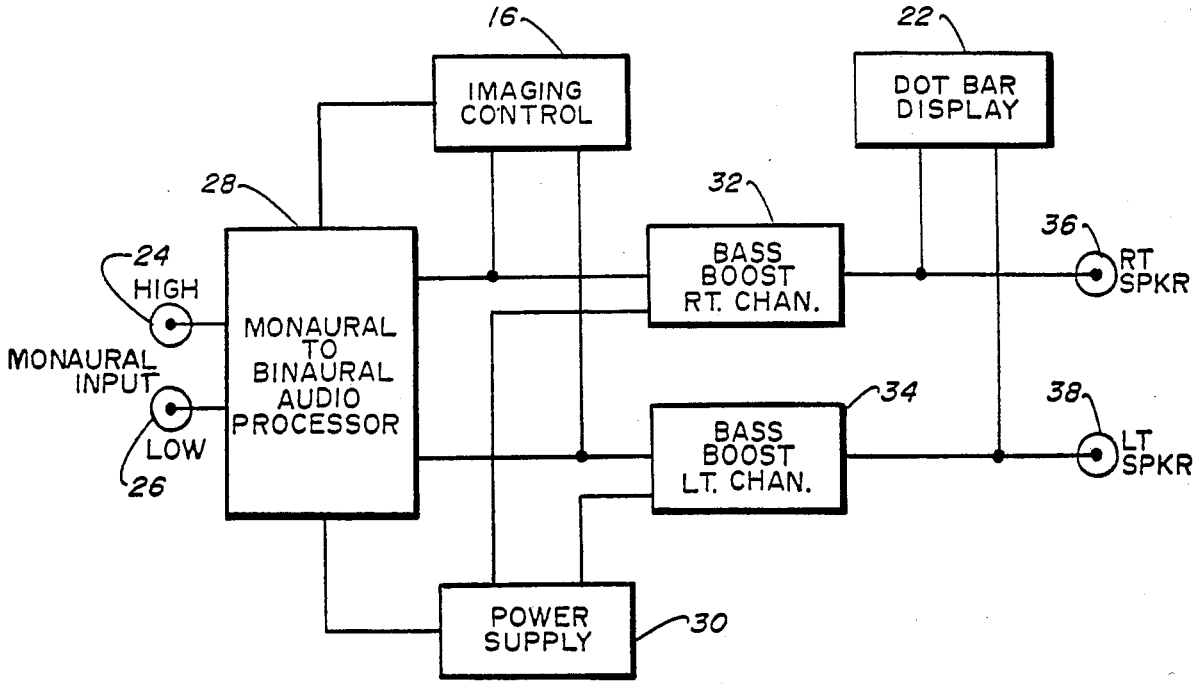
FIG. 2 is a block diagram of one embodiment of the audio processing system according to the invention.

The audio processor is shown generally in the block diagram of FIG. 2 and provides for either a high monaural input at terminal 24 or a low monaural input at 26 as selected by switch 12. The monaural to binaural converter 28 processes a monaural input to provide a truly remarkable high quality binaural output and is the heart of the system. A power supply 30 provides regulated power to the monaural to binaural converter 28 and bass boost circuits 32 and 34 connected to the left and right terminals 36 and 38 respectively, for connection to preamplifiers, amplifiers, etc. The dot bar display 22 is connected to the outputs of the bass boost circuits 32 and 34 to provide a visual indication of the right and left channel outputs.

Figure 3:
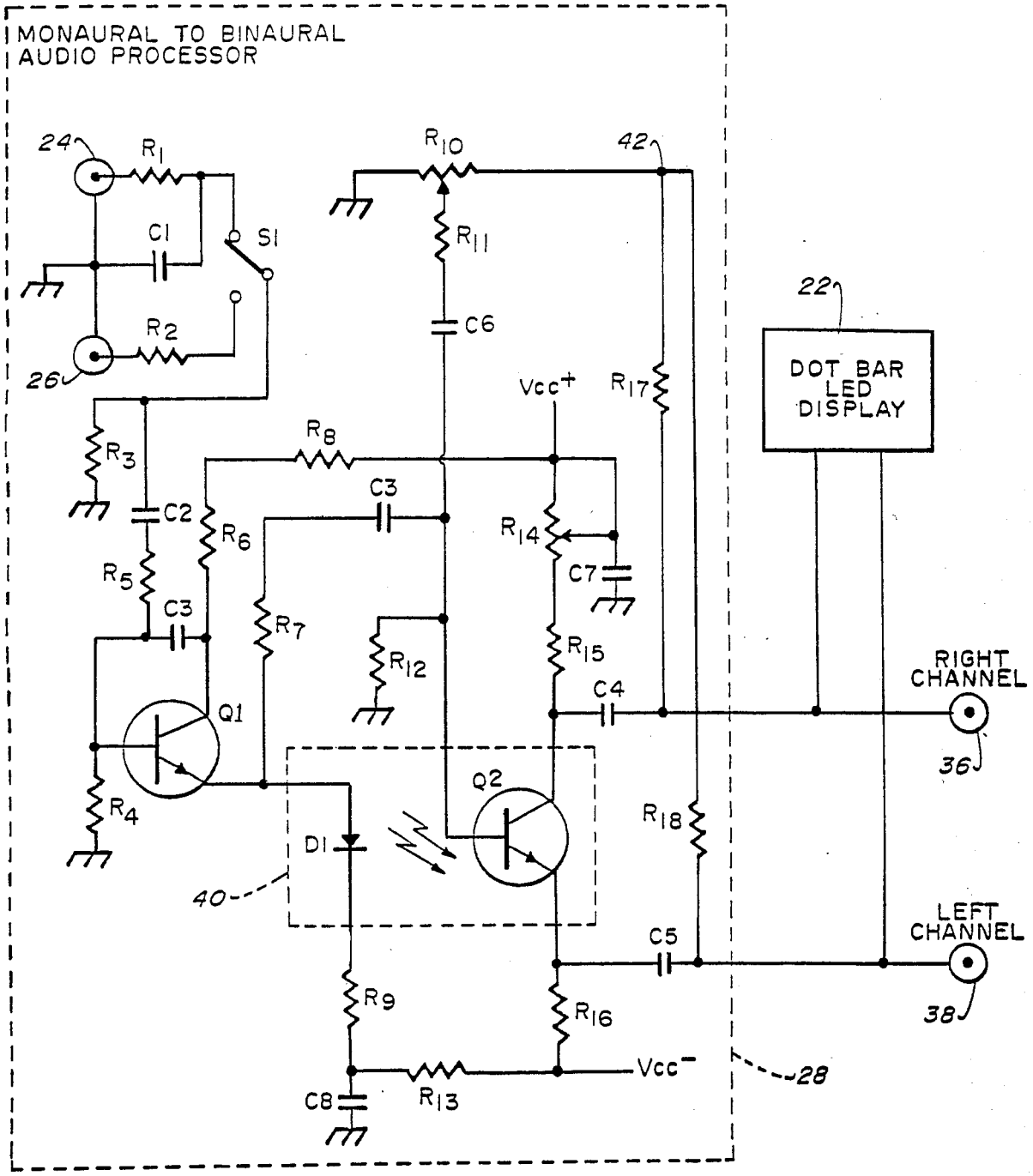
FIG. 3 is a schematic diagram of the monaural to binaural audio processor of FIG. 2.

One embodiment of the monaural to binaural converter 28 is illustrated schematically in FIG. 3. Switch S1 provides for selection between high and low level inputs to terminals 24 or 26 for connecting a monaural input to the converter 28. The monaural input to either of terminals 24 and 26 is connected through a low pass filter and a coupling capacitor C2 to emitter follower transistor Q1. Transistor Q1 is connected as an emitter follower to provide a low impedance reference point for the operation of the following circuitry. The function of the emitter follower transistor Q1 is primarily to drive light emitting diode D1 (LED) which is part of an optical coupling circuit 40, comprised of the light emitting diode D1 and phototransistor Q2. On large signal swings of the input signal on emitter follower Q1 the LED D1 will go from almost all the way off to a maximum brightness point. Thus, the LED traverses a large portion of its transfer characteristic and intentionally provides a nonlinear response that is delivered optically to the phototransistor Q2. Thus, the non-linearity of the light emitting diode D1 contributes to generating a difference in the output of Q2 which, to the ear, produces a subtle difference in the form of a binaural output which might be characterized as similar to stereo but to many listeners actually sounds better. The circuit of FIG. 3 does not generate a stereo signal but generates two output signals like stereo, creating a room or concert hall audio image. The optical coupling circuit 40 with other frequency selective networks and the configuration of feedback signals, as described more fully below, provides an output response whose frequency content, for example of a voice, tends to appear in either one or the other output signals depending on the position of the controls. This occurs because as the various frequencies are applied to these nonlinear elements through one of the signal paths provided, the audio output will tend, on the average, to appear primarily on one output signal rather than the other, due to a selected unbalance presented at the output.

The LED D1 provides a light output to phototransistor Q2 connected in a phase splitting network comprised of resistors R14, R15 and R16. The resistors are selected to provide an additional unbalanced input in addition to the unbalance due to the nonlinearity of the LED and phototransistor Q2. Thus, an audio signal applied to the input and coupled to the optical coupling circuit 40 will be modified dynamically by the interaction of the nonlinear transfer characteristics of the optical coupler and the frequency selective feed forward and feedback networks, such that a desired binaural output is provided to terminals 36 and 38.

The binaural output signals, referred to in FIG. 3 as the left and right channels, are generated as stated above by connecting the phototransistor Q2 as a phase splitter by selecting the emitter and collector load resistors such that there is a deliberate unbalance between the outputs on the collector and emitter of the phototransistor caused by the resistances selected and the nonlinearity of the phototransistor. Additionally, a potentiometer R14 can be included on one of the outputs of the phototransistor Q2 to act as an effective calibrate control to facilitate adjustment of the degree of unbalance between the collector and the emitter. The calibrate control R14, of course, can be either in the collector or the emitter as desired. Generally, the potentiometer R14 would be factory adjusted for optimum unbalance to provide the best binaural output to the right and left channels.

Inputs to the phototransistor Q2 arise via three paths. One path, described above, is an optical input from LED D1 which is a function of the input signal on the emitter follower transistor Q1 and the characteristics of the LED. Another path is the portion of the input signal which passes through a frequency sensitive network and drives the base of the phototransistor Q2. The frequency sensitive network is comprised of resistors R7 and R12 and capacitor C3 connected to the base of the phototransistor Q2 and the emitter of Q1. This frequency sensitive network adjusts the sensitivity and response characteristics of the phototransistor Q1 to provide a controlled nonliner transfer characteristic for the optical coupler 40.

The third input path to phototransistor Q2 is provided by a feedback network comprised of resistors R17 and R18 connected at one end to the output after coupling capacitors C4 and C5 and at the other end connected together to provide a summing point 42. The summing point 42 is connected to the base of the phototransistor Q2 by potentiometer R10, resistor R11 and capacitor C6. Potentiometer R10 permits more or less of the summed signal at summing point 42 to be applied to the base of the phototransistor through a frequency selective network comprised of the impedances of the potentiometer R10, series resistor R11 and the coupling capacitor C6, all having values chosen to have a high pass characteristic.

These three circuits actually cause phase shifts at various frequencies and the effect of these three circuits in combination produces subtle differences in amplitude and phase, as music or other program material from a monaural source goes through an infinite degree of variety as far as frequency and amplitude are concerned. As the program material is applied to the circuit, the combined effect of the three paths, the nonlinearity of the LED, the nonlinearity of the phototransistor in conjunction with the frequency selective feedback path and the frequency sensitive feed forward path from the emitter follower, provides this unique binaural output. Adjustment of the feedback potentiometer R10 provides imaging control of the output signal for the listener. That is, adjustment of this control will introduce desired phase changes into the binaural output signals that will affect the imaging of the binaural output.

To recapitulate, in FIG. 3, a monaural input signal is first applied through a coupling network to emitter follower transistor Q1 which provides a low impedance output drive, which is then divided among a light emitting photodiode D1, a frequency sensitive network that drives the base of phototransistor Q2 directly which is, in turn, summed with the feedback signal which is, in turn, a sum of the output signal from the phototransistor to the phase splitting network having an optimized unbalanced output. This output will provide a unique binaural signal having a tremendously pleasing sound to the listener.

A unique aspect of the present invention is that the monaural input to binaural converted output suffers substantially no loss in frequency response. That is, all the frequencies of the input are still readily available in the output, permitting a substantial bass and treble boost to be applied to further enhance the system, if desired. A dot bar LED display for each channel may be provided and consists of a standard light emitting diode array driven by a bar dot driver and an operational amplifier controlled by a potentiometer calibrated input.

An additional advantage of the binaural audio processor is that it can be cascaded together to provide multiple channel outputs if desired. In this case, the right channel output 36 and left channel output 38 of the binaural audio processor of FIG. 3 would provide the monaural inputs to two succeeding binaural audio processors, which in turn would provide four outputs to four more binaural audio processors and so on, up to outputs of many multiple channels. For example, using as a monaural input the output of a movie projector preamplifier and cascading binaural audio processors, an eight channel output could be provided. This would allow strategic placing of speakers around a theater to surround the audience with sound. Greater multiples of channels can be provided by simply cascading additional sections of binaural audio processors. Each additional section will double the number of channels available if all outputs are used.

Figure 10:
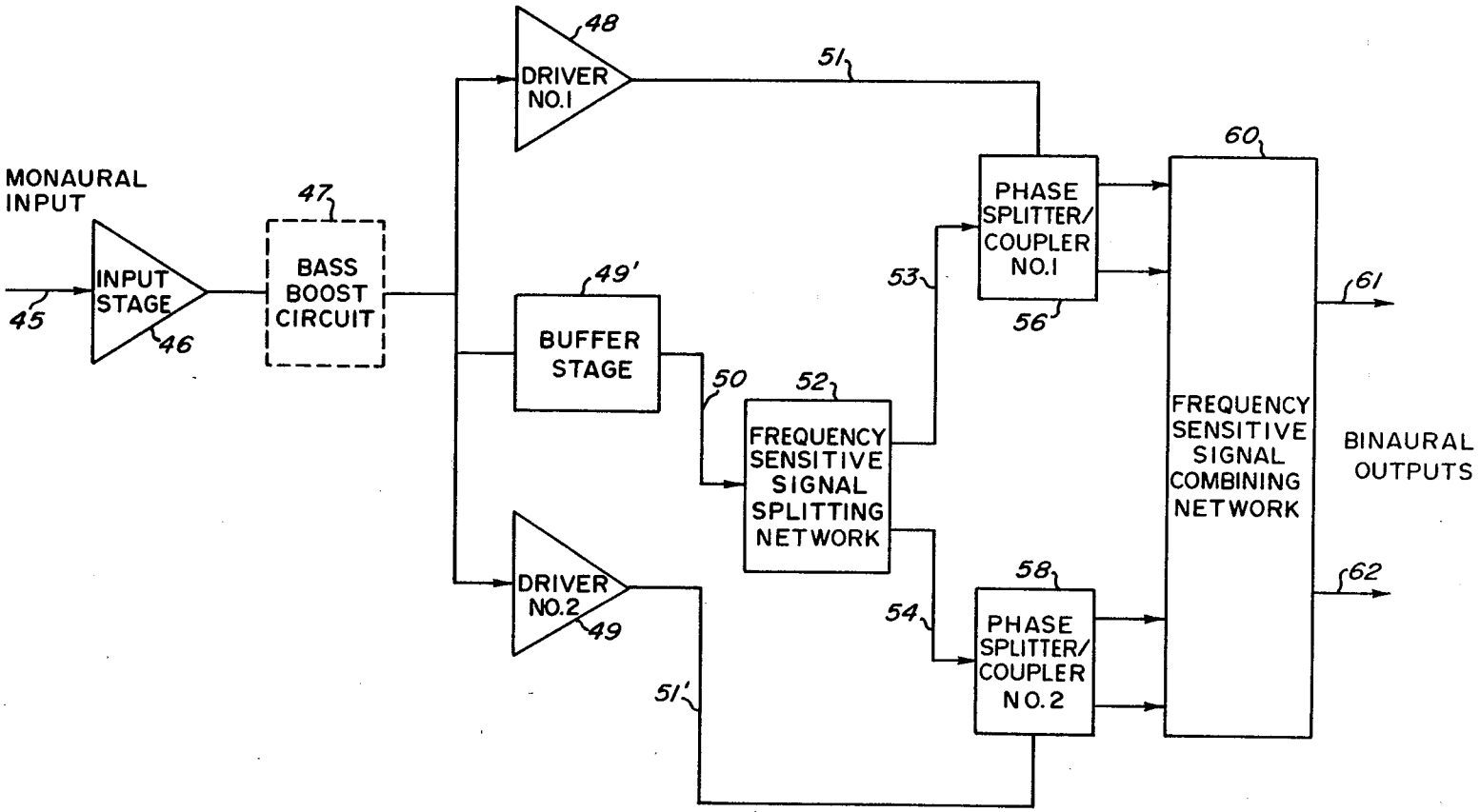
FIG. 10 is a block diagram of an alternative embodiment of the monaural to binaural audio processing circuit of the present invention.

Referring next to FIG. 10, a block diagram of an alternative embodiment of the monaural to binaural audio processing circuit 28 is shown, In this embodiment, a monaural input signal 45 is provided to an input amplifier/buffering stage 46. This input signal may be derived from a suitable selection network, such as that utilizing switch S1 in FIG. 3, if desired. Following the input stage 46, a conventional bass boost circuit 47 may be inserted, if desired. If a bass boost circuit 47 is inserted at this location, then the two bass boost circuits 32 and 34 (FIG. 2) would not be required.

Still referring to FIG. 10, two parallel driver circuits 48 and 49 further amplify and buffer the monaural signal and split it into two respective paths 51 and 51'. However, the primary signal path is through a buffer circuit 49' that presents the buffered monaural input signal to a frequency sensitive signal splitting network 52. This network 52 divides the signal as a function of frequency into two channels, represented as signal paths 53 and 54 in FIG. 10. Preferably, the splitting function of the network 52 allows all or most frequencies present in the monaural input signal to be present in both signals, i.e., the signal of channel 53 and the signal of channel 54. However, some frequencies present in channel 53 will dominate (be of greater amplitude) other frequencies present in channel 53. Similarly, some frequencies present in channel 54 will dominate other frequencies present in channel 54. The dominating frequencies of channel 53 are not necessarily the same as the dominating frequencies of channel 54.

Each channel is connected to a phase splitter/coupler circuit 54 or 58. It is the function of these circuits 56 or 58 to split the phase of the incoming signal and to modify the phase and gain of the resulting output signals in a desired nonlinear fashion. A significant portion of this nonlinear phase/gain modification is achieved by coupling the signals from the drivers 48, 49 to the respective phase splitter/couplers 56, 58. As will be explained more fully below, in the preferred embodiment this coupling is realized optically, thereby activating desired nonlinear transfer characteristics of the associated components as described previously in connection with the optical coupler 40 of FIG. 3. However, it is contemplated that other suitable coupling mechanisms, such as magnetic devices (nonlinear transformers, Hall effect devices, etc.) could be used.

Each phase splitter/coupler network provides two output signals that are presented to a frequency sensitive signal combining network 60. This network 60 selectively combines the four signals so as to provide the binaural output signals 61 and 62, which output signals 61, 62 may be thought of, for audio processing system configuration applications, as equivalent to the outputs 36, 38 of FIG. 3.

As with the embodiment of FIG. 3, the embodiment of FIG. 10 provides a highly desirable set of audio output signals that, when converted to audible sound through appropriate speaker, recording, or equivalent systems, produces a high fidelity audio sound that is spacious, full, and appears much more natural and realistic than is available through other audio signal processing systems known to the inventor.

In operation, the circuit of FIG. 10 thus splits the incoming signal as a function of frequency into two channels 53 and 54. Each split signal is thus different from the other in that each is dominated by a different range of frequencies. These split signals are presented to respective phase splitter networks 56 and 58, which phase splitting networks desirably alter in a nonlinear fashion the phase and gain of the resulting output signals. This nonlinear alteration is further enhanced by coupling energy from the monaural input signal into the networks 56 and 58, which coupled energy is used to shift the phase or modify the amplitude of the output signals. The outputs of the phase splitter/coupler networks 56 and 58 are appropriately combined in a signal combining network 60 to produce the desired binaural output signals. Every frequency present in the monaural input signal is present in the output signals, although the output signals are desirably unbalanced in phase and amplitude so as to produce a pleasing quality of sound that appears more natural, full, and spacious to a human's binaural hearing system.

Figure 11:
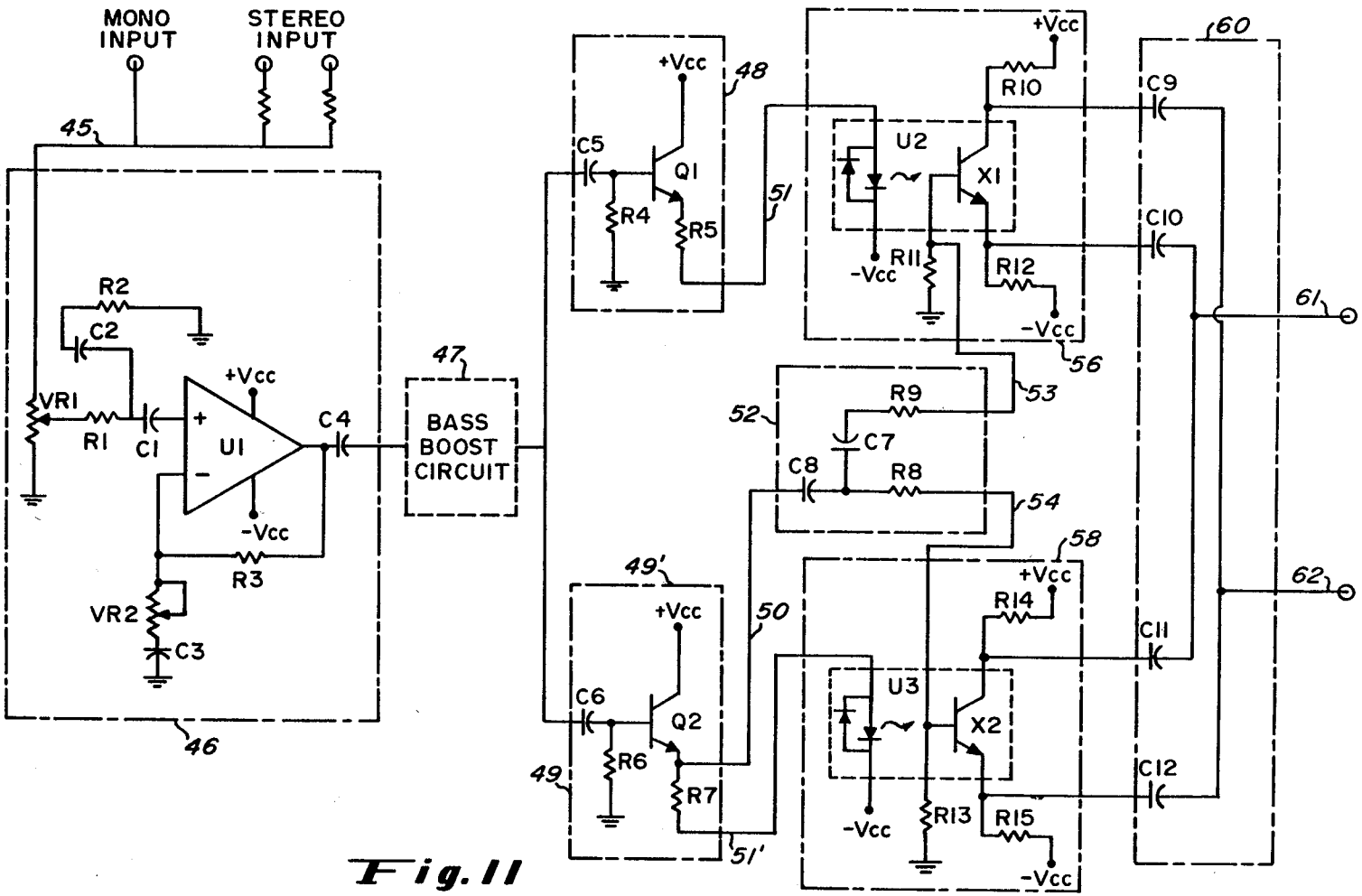
FIG. 11 is a schematic diagram of the block diagram of FIG. 10.

FIG. 11 is a schematic diagram detailing the preferred embodiment of the block diagram of FIG. 10. The input stage 46 is realized with a low noise operational amplifier (op amp) U1 and associated external passive components. The primary function of this input stage is to amplify the monaural input signal received on signal line 45. The variable resistor VR1 provides an audio taper control, and the R2, C2, network functions as a radio frequency interference (RFI) filter to keep unwanted RF signals out of the audio path. The gain of the op amp may be varied with variable resistor VR2. U1 may be realized with a UA741 op amp available commercially from Fairchild Semiconductor, Inc.

The bass boost circuit 47, if used, may be of any conventional design.

The driver circuits 48 and 49 generate the signals that are applied to the optical coupler circuits U2 and U3 of the phase splitter/coupler networks 56 and 58. Each of these driver circuits are biased as an emitter follower circuit using transistors Q1 or Q2. These transistors are selected for high beta and low noise. For example, a suitable transistor would be the MPS 8099 or the MPS A18 manufactured by Motorola. Advantageously, the driver circuit 49 also functions as the buffer circuit 49' that delivers the buffered monaural input signal to the signal splitting network 52. That is, the buffer circuit 49' is realized by utilizing Q2 as a conventional emitter follower, with the output signal to the signal splitting network 52 being taken from the emitter of Q2. The driver circuit 49 is realized using this same emitter follower configuration with the emitter current Q2 being delivered to the diode side of the optical coupler U3 through resistor R7.

Figure 12:
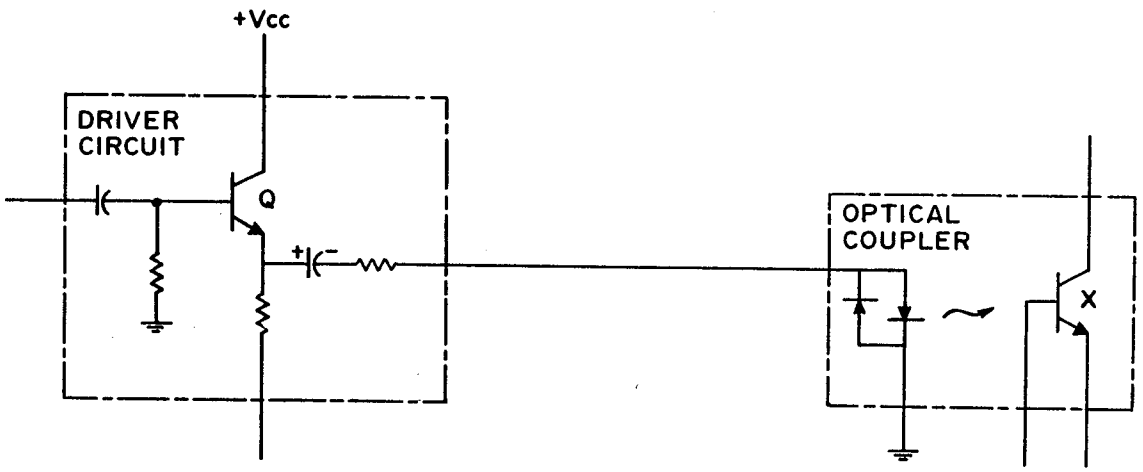
FIG. 12 is a schematic diagram of an alternative method of coupling a driver circuit to an optical coupler device as is done in FIG. 11.

In operation the LED (light emitting diode) sides of the optical couplers U2 and U3 are connected in series with the respective emitter resistors R5 or R7 of transistors Q1 or Q2. Resistors R4 and R6 are selected to place the base of transistors Q1 and Q2 at a desired bias potential. Resistors R5 and R7 are then selected such that the forward biased diode of each LED pair has a desired bias current flowing therethrough. As the monaural input signal is applied to the base of transistors Q1 and Q2, the current flowing through the forward biased LED swings about the bias current level, thereby causing the amount of light emitted by these LED's to vary. When the bias current through the LED is selected at a low level, such that the LED only faintly glows at this bias current level, the LED actually pulses when the monaural input signal is applied. This is because signal swings that cause more current to flow through the LED cause it to emit more light (LED on), and signal swings that cause less current to flow through the LED cause it to emit less light (LED off). The "pulsed" light generated by the LED's of U2 and U3 is coupled to the respective phototransistors X1 and X2, as described below. Note, that as described, the back-biased LED of each LED pair within U2 and U3 does not normally turn on (emit light). As such, this back-biased LED could be removed, although it does appear to add some desirable capacitance to the circuit that improves the operation (quietness) of the circuit. FIG. 12 shows an alternative circuit configuration that could be used with either driver/optical coupler combination wherein both diodes are pulsed depending upon the signal polarity. The optical couplers U2 and U3 are preferably realized with a commercially available H11AA1 optical coupler device, manufactured by General Electric.

Referring again to FIG. 11, the signal splitting network 52 is realized using resistors R8 and R9, and capacitors C7 and C8. As those skilled in the art will recognize, by properly selecting the values of these components (R8, R9, C7, C8) the frequency components of the signals appearing on signal lines (channels) 53 and 54 can be desirably controlled.

The signal split onto channel 53 is connected directly to the base of phototransistor X1 of optical coupler U2. Similarly, the signal split onto channel 54 is connected directly to the base of phototransistor X2. The collector and emitter of each phototransistor is connected to appropriate load resistors (R10 and R12 for X1; R14 and R15 for X2) so as to provide a phase splitting network, with the signals developed across these loads representing the signals of different phase. That is, the signal at the collector of X1 (across R10) is out of phase with the signal at the emitter of X1 (across R12). Similar out of phase signals are developed at X2 across R14 and R15. However, none of these four signals (two from X1, and two from X2) are the same. There are desirable changes in phase and amplitude between them all. These changes in phase and amplitude are introduced by the same mechanisms described previously in connection with FIG. 3. Further unbalance is created in connection with the circuit of FIG. 11 due to the different channels through which the signals are processed. That is, in practice there are no two components that are exactly alike. Therefore, even though in theory the two signals used to drive the LED's of U2 and U3 should be identical (having been developed through "identical" driver circuits 48 and 49 from the same monaural input signal), in practice there will be subtle differences between these signals. Further, the optical couplers themselves will be different, and will exhibit different nonlinear transfer characteristics from the LED to the phototransistors; and each phototransistor will have slightly different gain characteristics. All of these factors, coupled with the deliberately different signals that are applied through the signal splitting network 52, cooperate to produce a desirable mix of signals at the outputs of the phototransistors that represent slight variations in amplitude and phase.

The signal combining network 60 combines each of the signals from phototransistor X1 with appropriate signals from phototransistor X2 to produce the desired binaural output signals 61 and 62. In FIG. 11, this combining network is a passive circuit that is realized using coupling capacitors C9, C10, C11 and C12. Advantageously, the values of these capacitors may be selected to make the signal combining function frequency selective. For example, by making the value of C9 small compared to the value of C12, the dominant signal appearing at the output terminal 62 will be the signal from the emitter of X2. However, this signal is advantageously augmented by the higher frequencies from the out of phase signal from the collector of X1. Similarly, by making the value of C10 large compared to the value of C11, the dominant signal at the output terminal 61, which is obtained from the emitter of X1, will be augmented by the higher frequencies from the out of phase signal from the collector of X2. This particular combination of signals adds depth and width to the sound that is ultimately produced from both of the binaural output signals.

Figure 4:
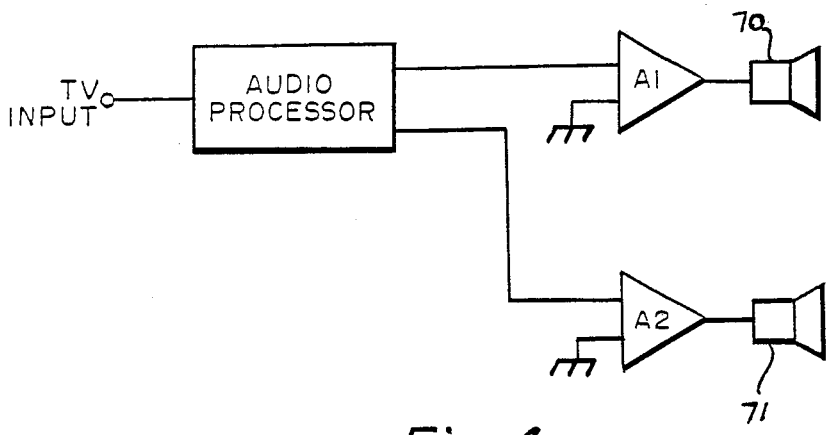
FIG. 4 is a simplified block diagram showing one application utilizing the audio processing system of the invention.

The monaural to binaural signal processing circuitry (whether that of FIG. 3 or FIG. 10) has a variety of uses as illustrated in FIGS. 4 through 9. In FIG. 4 the monaural to binaural processing circuit is shown connected to amplifiers A1 and A2 to convert a monaural television input to a binaural output which is amplified by amplifiers A1 and A2 and then delivered to speakers 70 and 71. The use of the monaural to binaural processing circuitry of the present invention provides an excellent alternative to stereo for TV audio.

Figure 5:
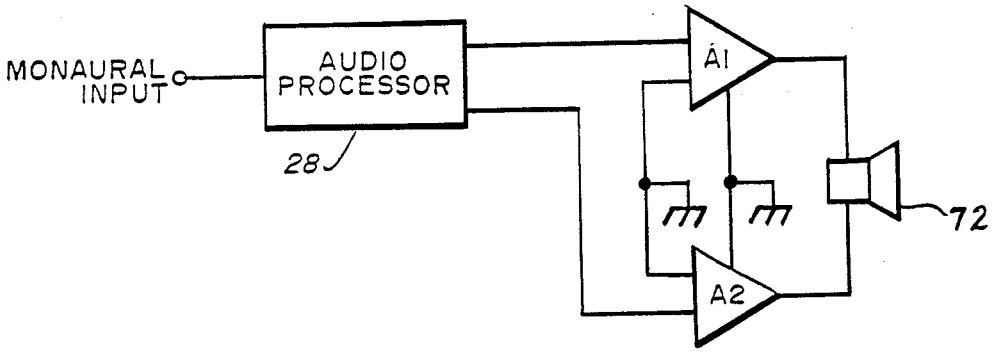
FIG. 5 is another block diagram showing another use of the audio processing system.

Another use of the monaural to binaural converter is illustrated in FIG. 5 in which the device is used for bridging a stereo amplifier. A monaural input signal is processed through the converter or processor 28 providing a plus and minus output for bridging to high fidelity power amplifiers A1 and A2. Amplifiers A1 and A2 are connected in parallel so as to provide a double power output, meaning that the output signals delivered to the speaker 72 have twice the amplitude swing, with one amplifier "pushing" while the other is "pulling". This double power output is provided without introducing signal distortion (clipping), as commonly occurs if the amplifiers are not bridged.

Figure 6:
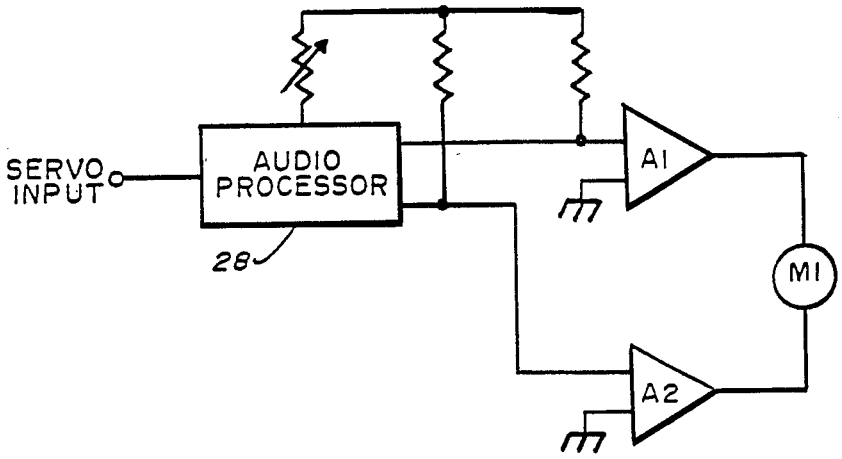
FIG. 6 is a simplified block diagram illustrating yet another utilization of the audio processing system of the present invention.

The circuit of FIG. 6 illustrates the use of the monaural to binaural signal processor for a servo motor system control. A servo input at a particular frequency, say 400 Hz, is processed through the processor 28 and the two outputs are presented to servo amplifiers A1 and A2. These amplifiers drive motor M1 connected across the outputs of the amplifiers. By controlling the amount of unbalance in the output signals, a highly accurate and reliable servo control is provided. Depending upon the particular servo application, additional circuitry may be needed to count pulses, rectify and average signals, and similar techniques commonly used in the servo control art. Further, if the configuration of FIG. 10 or 11 is employed, the circuit can be simplified by disabling the phase splitter 56 and driver 48.

Figure 7:
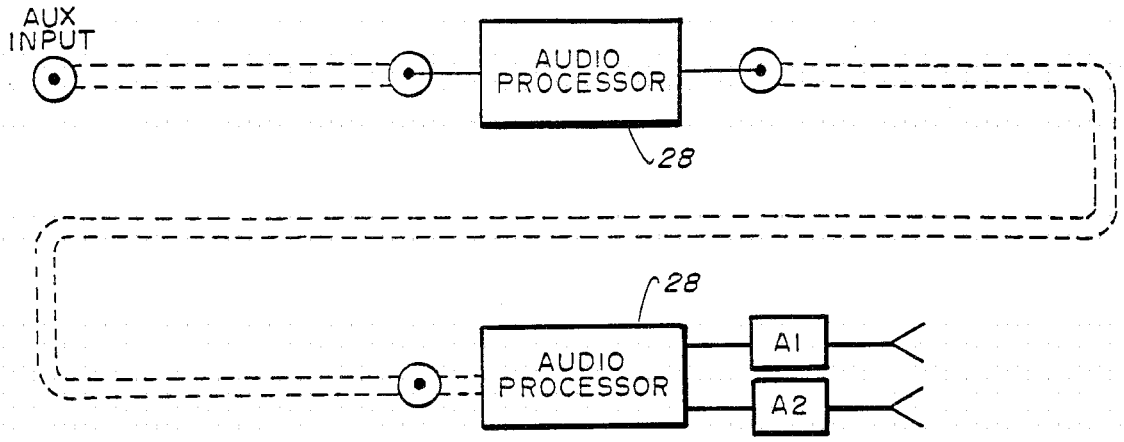
FIG. 7 is a simplified block diagram illustrating the use of the audio processing circuit as a line driver.

In the circuit of FIG. 7 the processor circuit 28 is shown used as a line amp in long cable lines. Each unit provides constant gain at various points along the long cable lines which then can provide a binaural output to amplifiers and speakers. The input may be any type of audio signal such as from telephone, radio, tape recorder, TV, etc. The circuit 28 processes the signal to provide a constant gain output at selected intervals. The signal is finally delivered to a last converter which outputs the signal to amplifiers A1 and A2 and then to speakers, or other suitable termination. Again, if the processor configuration of FIGS. 10 or 11 is employed, the circuit may be simplified by disabling X1 and its associated circuitry (i.e., not using channel 53).

Figure 8:
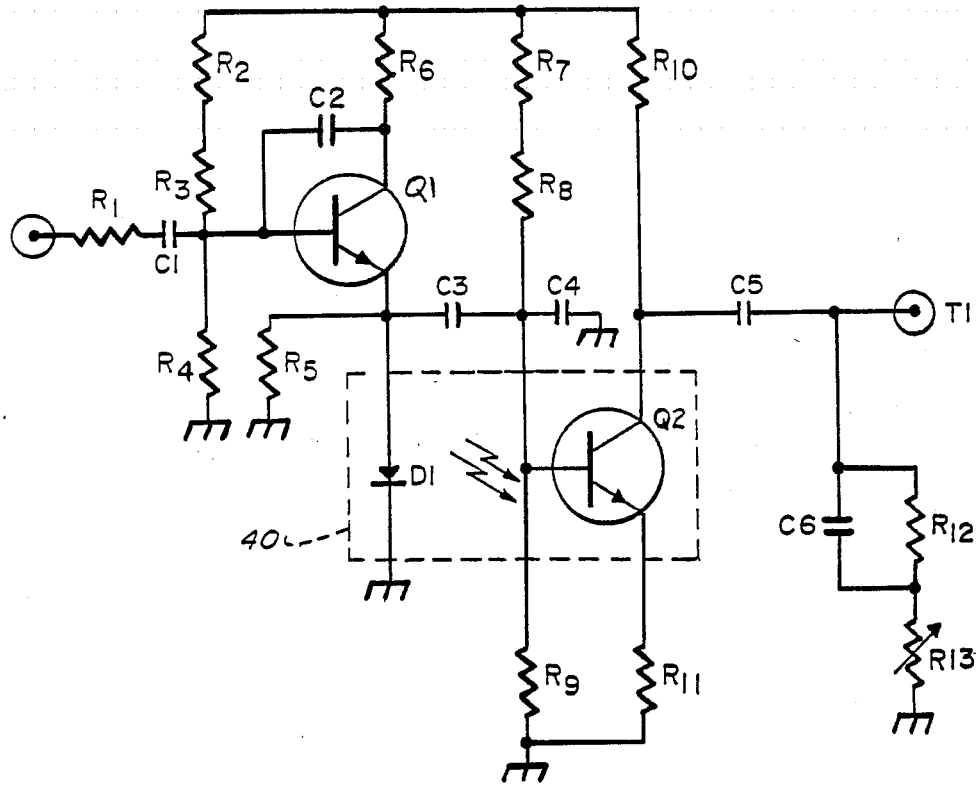
FIG. 8 is a schematic diagram illustrating the use of one embodiment of the audio processing circuit as a noise reduction device.

In FIG. 8 the basic monaural optical coupled converter of FIG. 3 is shown in use as a noise reduction circuit. Here the emitter follower Q1 provides an output to the optical coupler 40, which by its nature provides a transfer characteristic which tends to cut out noise being transferred to the output of the phototransistor Q2. The converter shown in FIG. 8 is modified to provide a single output when used for noise reduction. Capacitor C4 is added to the base of phototransistor Q2 and is selected for noise reduction. If desired, the capacitor could simply be added to the base of the phototransistor Q2 in FIG. 3 with a switch between the capacitor and ground. By switching the capacitor in or out of the circuit the audio processor 28 can be switched to the noise reduction circuit of FIG. 8 using only one of the outputs. Similarly, the circuit of FIG. 11 can be used as a noise reduction circuit by disabling one of the channels, replacing resistor R11 or R13 with a variable resistor (to control the bias point, and hence the transfer characteristics, of the remaining phototransistor), and using only one of the outputs.

The audio processing circuit of the present invention can also easily be adapted for use in automobiles or other portable applications. In such an instance, some modifications will have to be made in the biasing of the various circuit components because typically only a single battery or power source is available to power the processor, whereas the circuitry shown in the FIG. 11 is based upon having two power supplies, one positive and one negative (+VCC and −VCC). However, a conversion from dual supplies to a single supply is a relatively straight-forward process that can be readily performed by those skilled in the art.

Figure 9:
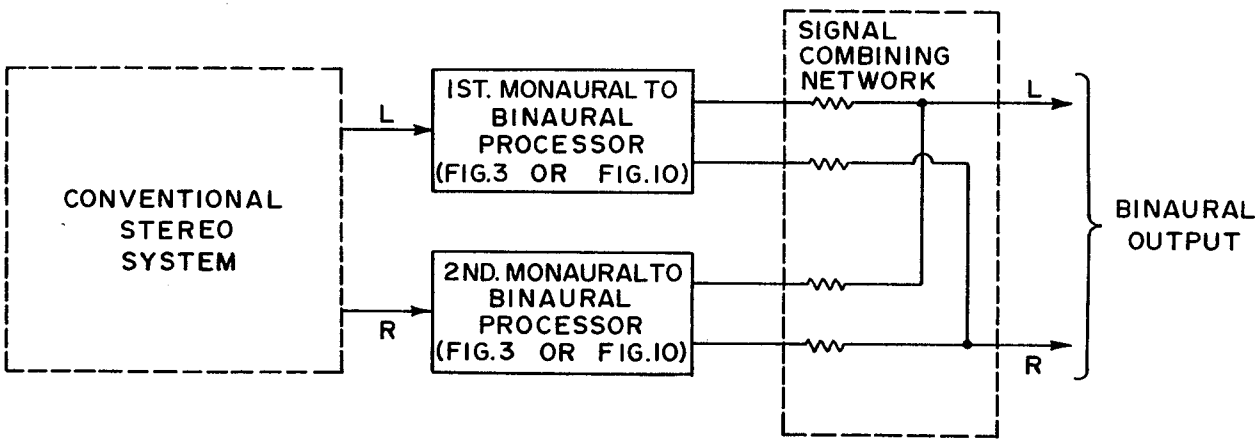
FIG. 9 is a simplified block diagram showing how the audio processing circuitry of the present invention could be used to process stereo signals.

FIG. 9 is a block diagram illustrating one method for using the processing system of the invention to process conventional stereo signals.

An added feature of the present invention is the ability to record and subsequently playback the binaural output signals that are produced by the processing circuitry of FIGS. 3 or 10 without degrading the playback signal by any substantial amount. Hence, all the subtle phase and amplitude changes that are generated across the full frequency spectrum of the binaural output signals may be saved and recorded in a suitable medium. When the saved signals are played back, the same phase and amplitude variations will be present (within the bandwidth amplitude limitations of the recording/-playback equipment used) as were present in the originally produced binaural signals. Thus, the played back sound will appear just as pleasing, spacious and full as did the originally produced sound.

The invention disclosed herein is not to be limited solely by the embodiment shown in the drawings and described in the description which is given by way of example and not of limitation but only in accordance with the scope of the appended claims.

I claim:

1. A monaural audio processing system comprising:
a monaural audio input;
a pair of audio outputs;
a low impedance drive means;
means coupling said monaural input to said low impedance drive means;
means being driven by said low impedance drive means, said means including phototransistor means for generating an unbalanced pair of outputs; and
output coupling means for coupling said unbalanced outputs to said audio outputs.

2. The system according to claim 1 in which said phototransistor means is responsive to light emitting diode means.

3. The system according to claim 2 in which said means being driven includes frequency sensitive feed forward means.

4. The system according to claim 3 in which said frequency sensitive feed forward means is connected to drive the base of said phototransistor means.

5. The system according to claim 4 including phase splitting means.

6. The system according to claim 5 in which said phase splitting means includes unequal resistors for unbalancing the outputs of said phase splitting means.

7. The system according to claim 6 in which one of said resistors is a potentiometer for adjusting and calibrating the effect of the unbalanced outputs.

8. The system according to claim 2 including feedback means for controlling the outputs of said phototransistor means.

9. The system according to claim 8 in which said feedback means comprises a dynamic summing circuit connected to the outputs of said phase splitting means.

10. The system according to claim 9 in which said dynamic summing circuit includes a potentiometer for adjusting said dynamic feedback means.

11. The system according to claim 1 in which said output coupling means includes a bass boost means for each of the outputs.

12. The system according to claim 1 including a dot bar display connected to said output coupling means.

13. The system according to claim 12 in which said dot bar display includes a light emitting diode display.

14. The system according to claim 13 in which there is a dot bar display for each channel.

15. The system according to claim 3 in which said low impedance drive means comprises an emitter follower connected transistor which drives said light emitting diode means.

16. The system according to claim 15 in which said feed forward frequency sensitive means comprises a series connected RC circuit between the emitter of said emitter follower and the base of said phototransistor means.

17. the system according to claim 1 in which said monaural input is a television audio input; and said output coupling means includes an audio amplifier and a pair of speakers.

18. The system according to claim 1 in which said output coupling means comprises a pair of bridged stereo amplifiers and a pair of speakers.

19. The system according to claim 1 in which said output coupling means includes a pair of servo amplifiers and a motor.

20. The system according to claim 1 in which said output coupling means comprises a long line cable; said audio processors being spaced at predetermined intervals along said long cable line; the last of said audio processors being output coupled to a pair of amplifying means and speakers.

21. An audio processing system comprising:

a monaural audio input;

low impedance drive means;

means coupling said audio input to said low impedance drive means; and optical coupling means including phototransistor means responsive to said low impedance drive means for generating a pair of unbalanced phase shifted outputs.

22. The system according to claim 1 in which a plurality of said audio processors are connected in parallel to said monaural audio input to provide multiple channel outputs.

23. The system according to claim 22 in which:

said monaural input is a movie projector preamplifier output; and said plurality of audio processors are connected in parallel to said monaural audio input to provide at least eight channels of output from said preamplifier input.

24. A method for generating a pair of binaural signals from a monaural input signal comprising the steps of:

(a) splitting the input signal into a plurality of signals;

(b) optically modifying the instantaneous amplitude and phase of each split signal in a non-balanced fashion through a phototransistor; and (c) combining the modified signals to produce said pair of binaural signals.

25. The method of claim 24 wherein step (b) comprises:

(1) applying a selected portion of the monaural input signal to the base of said phototransistor;

(2) optically coupling energy from selected portions of the monaural input signal to said phototransistor; and (3) generating out of phase signals at the collector and emitter terminals of said phototransistor.

26. The method of claim 25 wherein step (2) of optically coupling the energy to the base of said phototransistor comprises generating separate drive signals for pulsing an LED in optical proximity to said phototransistor with signal swings of said monaural input signal that exceed a desired threshold level.

27. A method of converting a monaural signal to a set of binaural output signals comprising the steps of:

(a) coupling said monaural signal to a phase splitting network including a phototransistor, said phase splitting network being adapted to generate a plurality of output signals from said phototransistor, each having a phase different from the others, and each having an instantaneous amplitude that is a function of the instantaneous amplitude of the signal coupled to said phase splitting network; and (b) generating said set of binaural output signals from said plurality of output signals of said phase splitting network.

28. The method of claim 27 wherein the different phased output signals generated by said phase splitting network are derived from circuitry connected to the emitter and collector terminals of said phototransistor, and further wherein step (a) includes optically coupling a selected portion of the monaural signal to said phototransistor.

29. The method of claim 28 wherein step (a) further includes electrically connecting a selected portion of said monaural signal directly to the base of said phototransistor.

30. The method of claim 29 wherein step (a) further includes electrically connecting a selected portion of the binaural output signals directly to the base of said phototransistor.

31. A monaural to binaural signal processing system comprising:

means for generating an optical signal in response to a monaural input signal;

signal splitting means including phototransistor means responsive to said optical signal for splitting said monaural input signal into a plurality of signals and for modifying the instantaneous amplitude and phase of each of said split signals; and signal combining means for selectively combining said modified split signals so as to produce a set of binaural output signals.

32. The monaural to binaural system of claim 31 wherein said signal splitting means includes:

phase splitting means for generating a plurality of phased signals from each of said split signals, each of said phased signals having a different phase from the other of said phased signals derived from the same split signal, and each having an amplitude that is a function of a control signal applied to an input of said phase splitting means.

33. The monaural to binaural system of claim 31 wherein said phototransistor means has load resistors connected to emitter and collector terminals thereof, and wherein said split phase shifted signals are derived from the voltages developed across said load resistors.

34. The monaural to binaural system of claim 31 wherein said generating means comprises:

means for electrically applying a selected portion of said monaural input signal to a base terminal of said phototransistor means; and means for optically coupling energy derived from said monaural input signal to the base of said phototransistor means.

35. The monaural to binaural system of claim 34 wherein said means for optically coupling energy to the base of said phototransistor means comprises a light emitting diode that is in optical proximity to said phototransistor means and that is electrically connected to a driving circuit, said driving circuit being adapted to deliver a signal current to said light emitting diode that varies proportionally with the instantaneous amplitude of said monaural input signal, whereby said light emitting diode emits radiant energy as a function of said signal current.

36. The monaural to binaural system of claim 34 wherein said signal splitting means splits said monaural input signal into two signal paths as a function of the frequency of said input signal, a first signal path having frequencies predominately from a first frequency range, and a second signal path having frequencies that include frequencies from a second frequency range.

37. The monaural to binaural system of claim 36 wherein the first signal path is applied to the base terminal of a first phototransistor, and the second signal path is applied to the base terminal of a second phototransistor, said means for electrically applying a portion of said monaural input signal to the base terminal of each of said phototransistors comprising said first and second signal paths, respectively.

38. The monaural to binaural system of claim 37 wherein said signal combining means comprises a network that selectively combines the four phased signals derived from the collector and emitter load resistors of each of said first and second phototransistors to produce a set of two binaural output signals.

39. The monaural to binaural system of claim 38 wherein said signal combining means combines the higher frequency components of the phased signal from the collector of the first phototransistor with the phased signal from the emitter of the second phototransistor to produce a first output signal, and further combines the higher frequency components of the phased signal from the collector of the sescond phototransistor with the phased signal from the emitter of the first phototransister to produce a second output signal.

* * * * *